US005232422A

United States Patent [19]

Bishop, Jr.

[11] Patent Number: 5,232,422

[45] Date of Patent: Aug. 3, 1993

[54] EXERCISE DEVICE

[76] Inventor: Thomas M. Bishop, Jr., 2015 Beecher St., Orlando, Fla. 32808

[21] Appl. No.: 748,871

[22] Filed: Aug. 23, 1991

[51] Int. Cl.[5] ..... A63B 22/06

[52] U.S. Cl. ..... 482/57; 482/64

[58] Field of Search ..... 482/57, 52, 54, 70, 482/64, 62, 112, 121, 83, 62, 72; 128/25 R; 280/304.2, 249, 250, 251, 255, 257, 259

[56] References Cited

U.S. PATENT DOCUMENTS

| | | | |
|---|---|---|---|
| 3,057,201 | 3/1959 | Jaeger | 482/57 |
| 4,479,646 | 10/1984 | Beistegui | 482/72 |
| 4,582,318 | 4/1986 | Giannelli | 272/73 |
| 4,717,146 | 1/1988 | Nohara | 272/73 |
| 4,796,882 | 1/1989 | Jiumur | 272/72 |
| 4,953,850 | 9/1990 | Lo | 272/73 |

*Primary Examiner*—Richard J. Apley
*Assistant Examiner*—Jerome Donnelly
*Attorney, Agent, or Firm*—Allen, Dyer, Doppelt, Franjola & Milbrath

[57] ABSTRACT

An exercise device having a driving sprocket coupled to a resistive driven sprocket. Pedals are connected to the driven sprocket and rotated by foot about an axis in a first direction. The driving sprocket and pedals may then be repositioned to a second position where the sprocket may be rotated by hand. The position of the sprocket as well as the direction of rotation of the sprocket can be adjusted to exercise various parts of the body. An indicator may be coupled to the device to display the speed of sprocket rotation irrespective of the direction of sprocket rotation.

9 Claims, 6 Drawing Sheets

EXERCISE DEVICE

BACKGROUND OF THE INVENTION

The invention relates to a method and apparatus for exercising using a rotating wheel or sprocket driven by a hand or foot. More particularly, this invention relates to an apparatus for exercising with a wheel mounted in a frame which can be detached and placed in a suitable position.

Stationary exercise devices are well known, and typically consist of a pedal that when rotated drives a sprocket which is connected by a chain to turn a wheel. The wheel is connected to a variable resistance to change the pedalling difficulty. The operator may increase their heart rate by pedalling the wheel using their arms or their legs. Examples of such exercise devices are disclosed in DeBoer et al. U.S. Pat. No. 4,705,269 and the patents cited in DeBoer.

One problem with these exercise devices is that they are typically bulky and take up a large amount of space. Accordingly, these devices are not easy to store and are difficult to transport.

Another drawback to prior exercise devices is that the operator must sit in a seat to use the device. The operator must then use either their hands or their feet to turn the wheel and operate the cycle. Operators that are bedridden or confined to a wheelchair need a position adjustable exercise device as they are not able to move around. Prior art exercise devices may be bulky and therefore not suited for persons with limited mobility.

When exercising with a stationary exercise device it is desirable to exercise in different positions. In addition to cardiovascular build-up, the operator exercising may want to tone up certain muscle groups requiring that the exercise device's pedal be in the proper position. Most of the prior art exercise devices have fixed pedal positions or pedal positions with very limited movement and thus do not accommodate variable positioning.

May exercise devices have pedals that are connected to the wheel and rotate at the same speed the wheel rotates. As the rotational velocity of the wheel increases so does the rotational velocity of the pedals. If the operator's foot slips off the pedal, the pedal may rotate around and injure the operator. Ratchets have been used on cycles to limit accidents in the event of pedal slippage by allowing the wheel to continue to rotate independently of the pedal. However, ratchets allow the pedal to rotate only in one direction. Thus, when the cycle is turned around, the ratchet prevents the pedals on the cycle from turning in the opposite direction.

SUMMARY OF THE INVENTION

The objection of this invention is to provide an improved exercise device.

Another objective of the invention is to provide an improved method for exercising with a cycle.

It is a further objective of this invention to construct an exercise cycle that is adjustable to accommodate persons who cannot get up and move around.

Also, an objective of the invention is to adjust positions on an exercise device so that the device may be used with the feet, the hands or other parts of the body.

It is another objective of the invention to construct an exercise device that may easily fold up and be hidden out of the way for use in homes having very little living space.

A further objective of the invention is to place a pawl on a bicycle pedal to reduce injury if the operator slips on the pedals and to allow the direction of the pedal rotation on an exercise cycle to change if the exercise cycle is turned around.

An additional objective of the invention is to provide a method of exercising with a cycle that can be adjusted to position levels easily operable with hands and to position levels easily operable with the feet.

These and other objectives are provided with an exercise device comprising a driving sprocket having a first axis of rotation and means for rotating said sprocket about said first axis. The exercise device also includes means having a second axis of rotation for supporting the sprocket about the first axis in the first position where the sprocket is adapted to be rotated by hand, and for rotating the sprocket about the second axis to a second position where the sprocket is adapted to be rotated by foot. Thus, the exercise device allows an operator to exercise both his upper body and lower body in various positions. In a preferred embodiment, the exercise device has a set coupled to the frame. Further, the exercise device can be adjusted by the operator from a foot-operated position to a hand-operated position with a foot so that the operator does not have to get up from the seat to change exercise positions. The exercise device also includes a ratchet for permitting the direction the pedals may be rotated to change. A speedometer is provided that can be adjusted to indicate the speed or distance traveled irrespective of the direction of rotation of the pedals and/or sprockets.

In another preferred embodiment a method of exercising is provided comprising the steps of providing a driving sprocket having a first axis of rotation positioned at a preselected level and then rotating driving sprocket about the first axis with a hand. The position of the driving sprocket is changed from a first predetermined level to a second predetermined level, and the driving sprocket is rotated about the axis with a foot when the driving sprocket's position is changed to the second predetermined level. Thus, exercising can be performed with a device either by using the upper body or the lower body.

DESCRIPTION OF THE PREFERRED EMBODIMENTS

Figure 1:
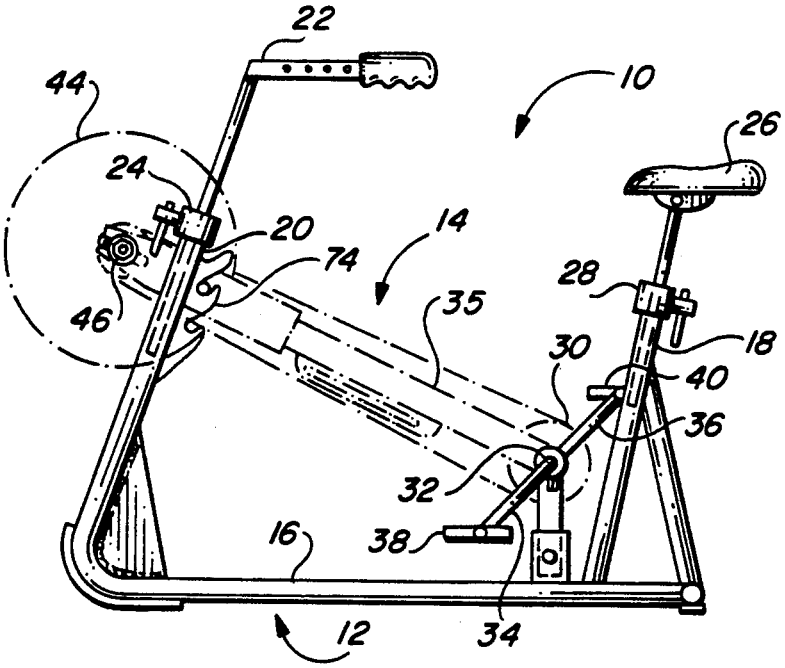
FIG. 1 is a side view of the exercise device in place for leg exercise.

Referring to FIGS. 1 through 5 there is shown a conventional type exercise device 10 having a support frame assembly 12 removably and hingedly coupled to driver frame assembly 14. Support frame assembly 12 includes support frame 16 integrally coupled to seat support bar 18 and handle support bars 20. Inserted into handle support bars 20 are handlebars 22 which are adjustable with ratchet assembly 24. Inserted into seat support bar 18 is seat 26 is adjustable on support bar 18 with adjuster 28. Although a support frame 16 is shown mounted on the floor, the frame may be mounted at other locations such as floors, walls, pedestals, bed rails, etc.

Referring to FIGS. 1, 2, 4–7, there is shown driver frame assembly 14 includes a driving sprocket 30 pivotally attached on axis or rod 32 which extends through longitudinally extending frame 35. Attached to rod 32 are pedal shafts 34 and 36 and pedals 38 and 40, respectively. When pedals 38 and 40 are turned, driving sprocket 30 rotates about rod 32. Disposed at the other end of longitudinally extending frame 35 from rod 32 is driven wheel 44.

Figure 6:
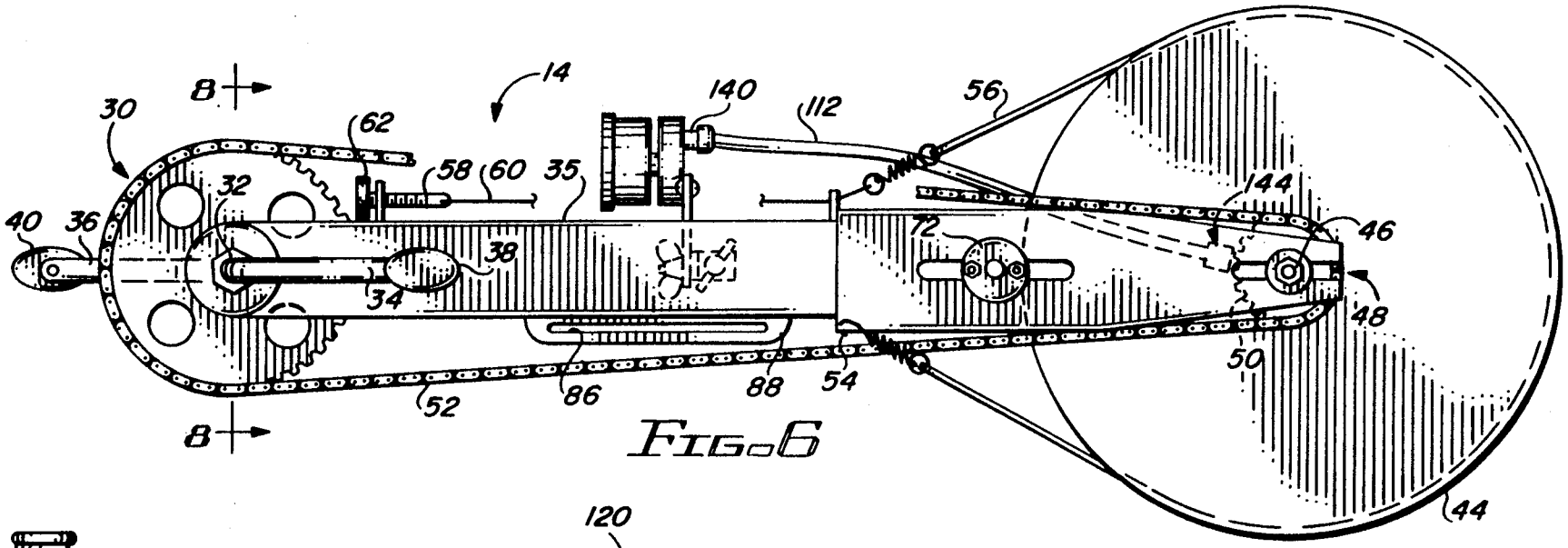
FIG. 6 is a side view of a frame with a sprocket and driven wheel in accordance with the invention.
Figure 7:
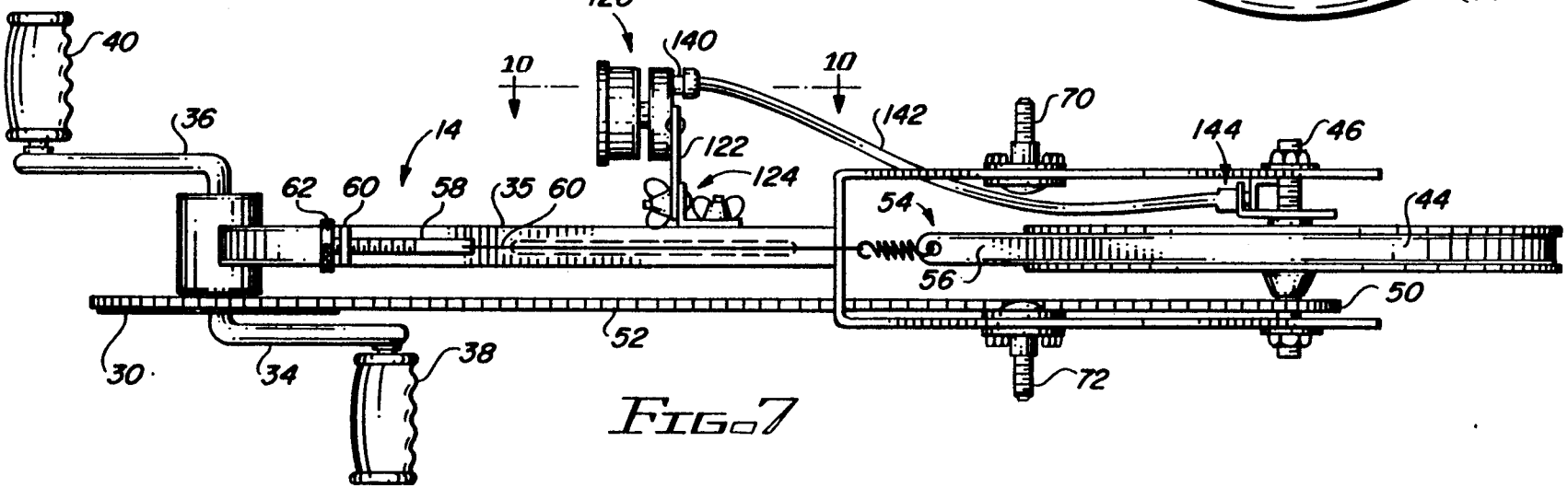
FIG. 7 is a top view of the device shown in FIG. 6.

Referring to FIGS. 6 and 7, driven wheel 44 is connected to longitudinally extending frame 35 with rod 46 which extends through slit 48 on longitudinally extending frame 35 and attaches to driven wheel 50. Driven wheel 50 is coupled to driving sprocket 30 with chain 52. The chain 52 may be constructed of steel, plastic or may be substituted with a linking device such as a belt, rope or pulley. When driving sprocket 30 rotates about rod 32, driven wheel 50 turns about rod 46 to rotate driven wheel 44.

Also coupled to longitudinally extending frame 35 is resistance assembly 54 which resists the turning of driven wheel 44. Resistance assembly 54 includes strap 56 which extends around driven wheel 44 and is coupled to adjustable screw 58 through wires 60. Wire 60 may extended alongside frame 35 or may extend through a slot (not shown) in frame 35. Screw 58 is attached to longitudinally extending frame 35 through brackets 61 and is held in place with hexnut 62. Hexnut 62 may be turned to change the rotational resistance of driven wheel 44.

Extending outward on both sides of longitudinally extending frame 35 are rods or screws 70 and 72. Referring to FIGS. 1–5, these screws attach to brackets 74 on handle support bars 20 and provide a second axis of rotation for driver frame assembly 14. Attached to longitudinally extending frame 35 below rod 32 is locating peg 78. Locating peg 78 in FIG. 1 is shown mating with a locating peg support socket 80.

Referring to FIG. 1 there is shown driver frame assembly 14 with longitudinally extending frame 35 angled downward so that pedals 38 and 40 are rotatable about rod 32 at a level below the level of seat 26. In this configuration, exercise device 10 functions in a normal bicycle exercise mode.

Figure 2:
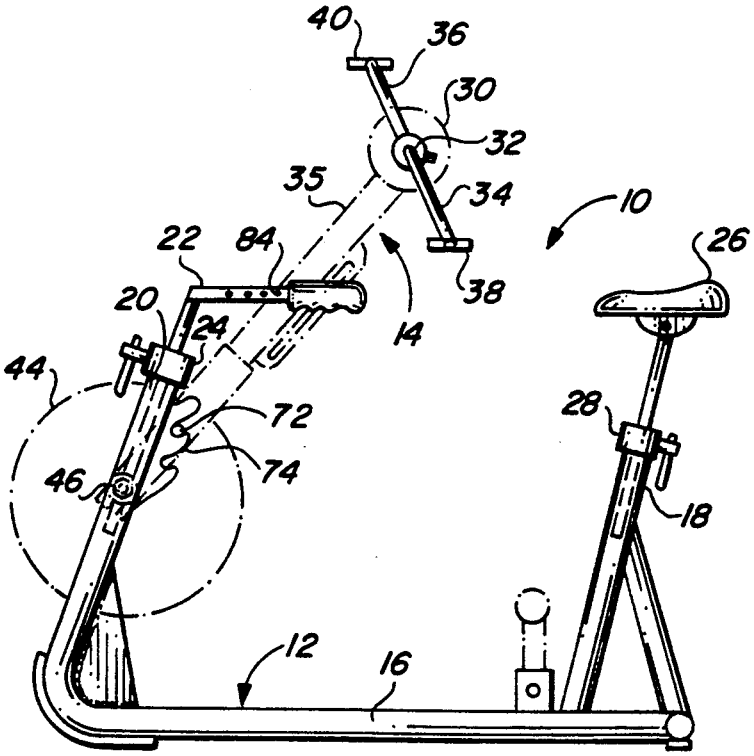
FIG. 2 is a side view of the device in position for arm exercise.
Figure 3:
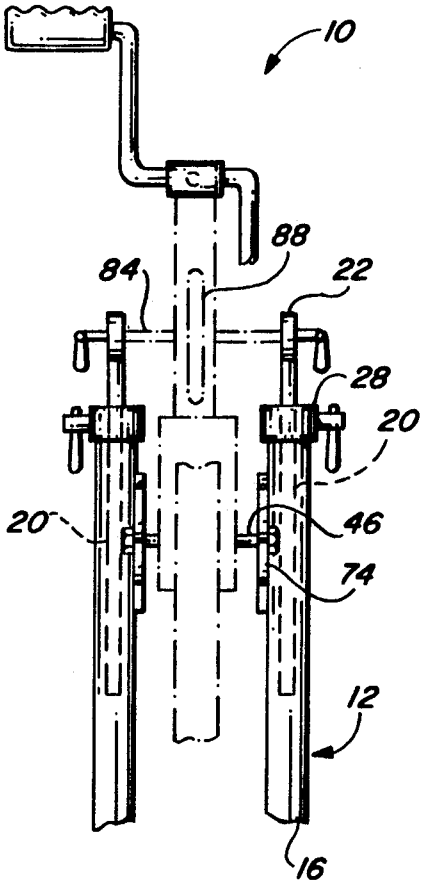
FIG. 3 is a front view of the device shown in FIG. 2.

Referring to FIG. 2, driving sprocket 30 is rotated upward about the second axis or rods 70 and 72 so that pedals 38 and 40 rotate about first axis or rod 32 at a level higher than the level of seat 26. Referring to FIGS. 2 and 3, longitudinally extending frame 35 is held in place with anchor rod 84 which extends through a slot 86 (FIG. 6) in flange 88. Slot 86 may preferably be cut out of frame 35. A magnet is preferably attached to one end of anchor rod 84 to hold it in place against handlebars 22. In this position shown in FIG. 2, the operator rotates by hand pedals 38 and 40 to driving sprocket 30.

Figure 4:
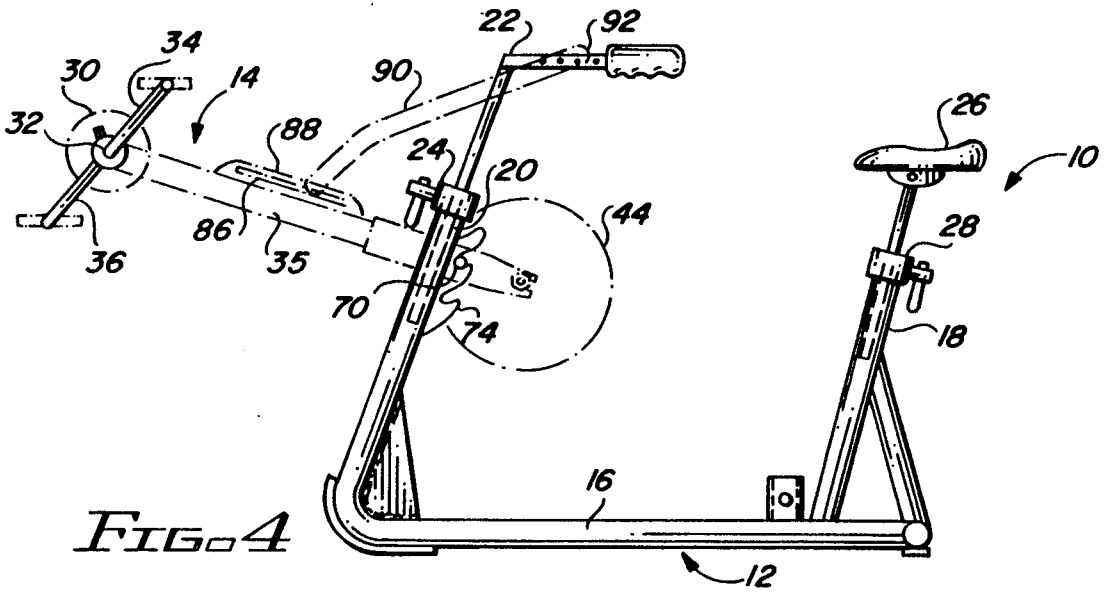
FIG. 4 is a side view of the device in position for arm exercise with a chair-bound person.

Referring to FIG. 4, longitudinally extending frame 35 is rotated about axis or rods 70 and 72 into a position where the operator can turn pedals 38 and 40 by hand when the operator is sitting in a wheelchair or on a bed. Longitudinally extending frame 35 is held in place with support arm 90 which is coupled at one end to flange 88 in slot 86 and coupled at its other end through aperture 92 and handlebars 22. When driving sprocket 30 is positioned to be rotated by hand, it is preferable that the direction of rotation of pedals be allowed to be changed and that driven wheel 44 continue to rotate when pedals 38 and 40 are stopped. Details of adjusting a pawl 114 to control pedal rotation will be discussed herein in connection with FIGS. 8 and 9.

Figure 5:
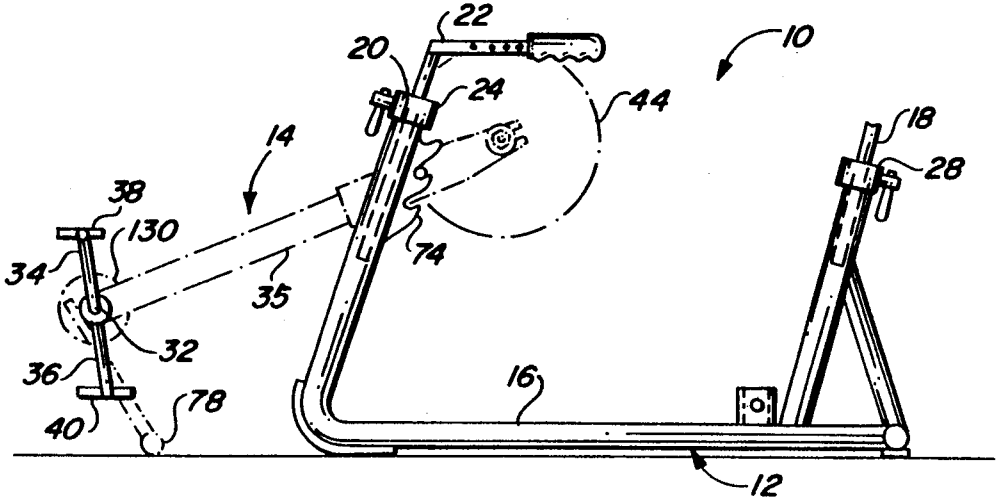
FIG. 5 is a side view of the device in position for leg exercise with a chair-bound person.

Referring to FIG. 5, longitudinally extending frame 35 is rotated about the second axis, or screws 70 and 72 into a position where locating peg 78 contacts the floor. In this position pedals 38 and 40 may be rotated by a person who is bedridden or in a wheelchair with their feet.

Figure 9:
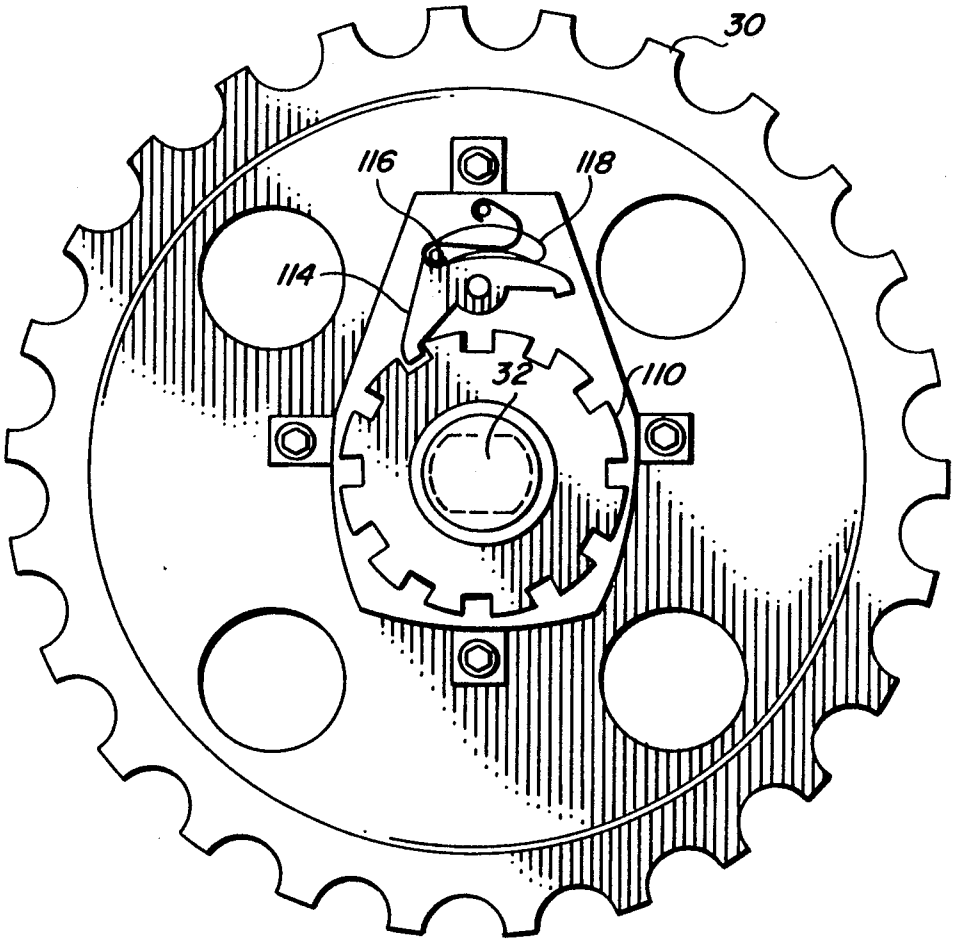
FIG. 9 is a side view of the reversible ratcheting sprocket system cut along line 9—9 of FIG. 8.
Figure 8:
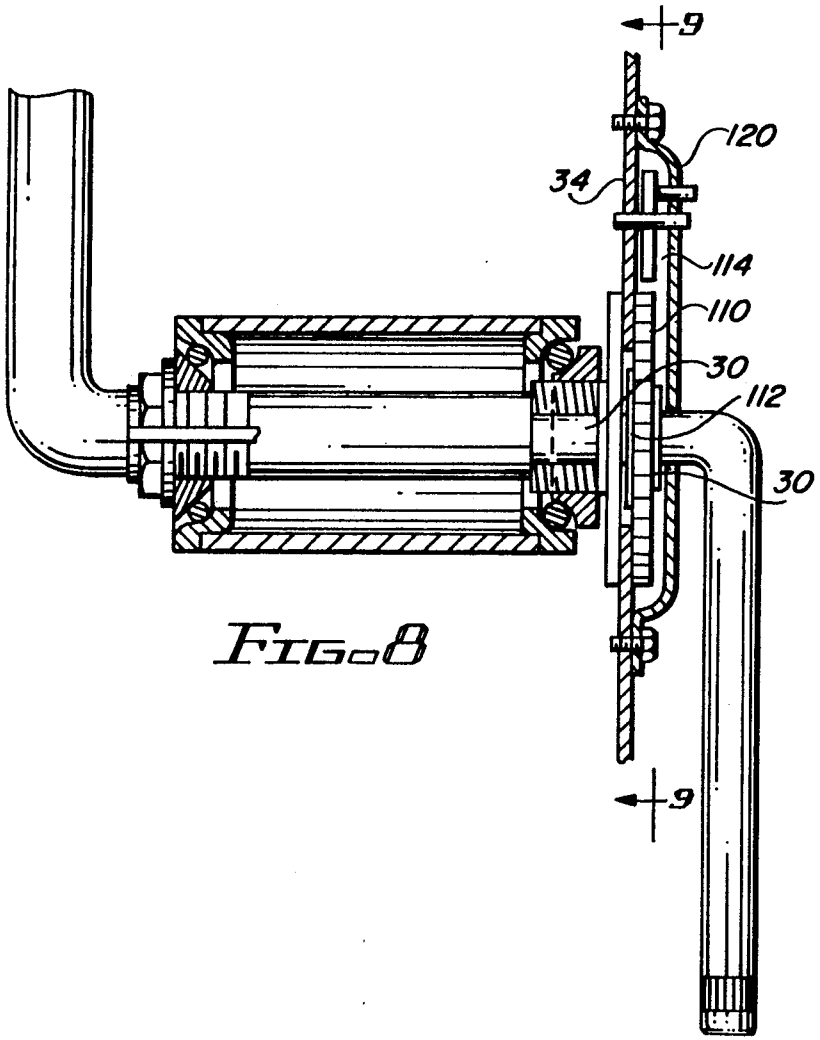
FIG. 8 is a section view of the ratcheting sprocket system cut along line 8—8 of FIG. 6.

Referring to FIGS. 8 and 9, pedal shafts 34 and 36 are shown connected together with rod 32. Rod 32 rests in housing 98 and is connected to flange 100 which rests on housing 98 with bearing 102 located in bearing race 104. Although bearings 102 are suggested, it may be preferable that bushings be used instead of bearings 102. Pedal shafts 34 and 36 are coupled to rod 32 with nut 108.

Referring to FIGS. 8 and 9, driving sprocket 30 is connected to rod 32 with inner driving sprocket 110 which is separated from longitudinally extending frame 35 with spacer 112. Also coupled to longitudinally extending frame 35 is pawl 114 which restricts the direction of movement of inner driving sprocket 110 as well as driving sprocket 30. The pawl 114 position is adjustable with knob 116.

Referring to FIG. 9, when pawl 114 is in the position shown, driving sprocket 30 is restricted to rotate about axis or rod 32 in the current clockwise direction. Knob 116 may be turned to rotate pawl 114 clockwise, thereby restricting driving sprockets 30 and 110 to rotate in a counter-clockwise direction about rod 32. A spring 118 holds pawl 114 in place while permitting inner driving sprocket 110 to turn. Inner driving sprocket 110, pawl 114 and spring 118 are all enclosed within a housing 120.

Figure 10:
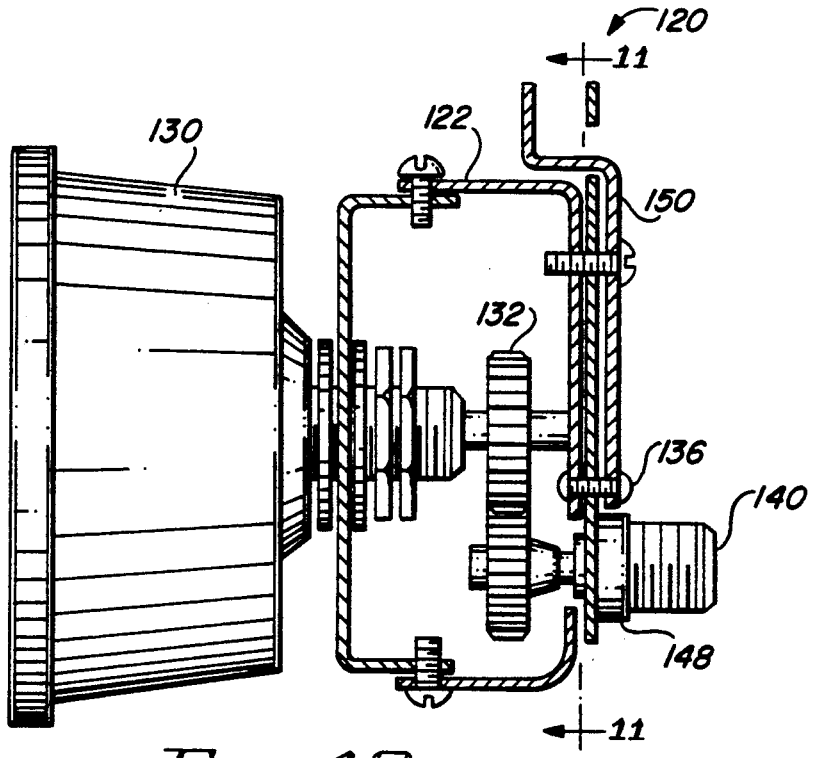
FIG. 10 is a section side view of the speedometer cut along lines 10—10 of FIG. 7.
Figure 11:
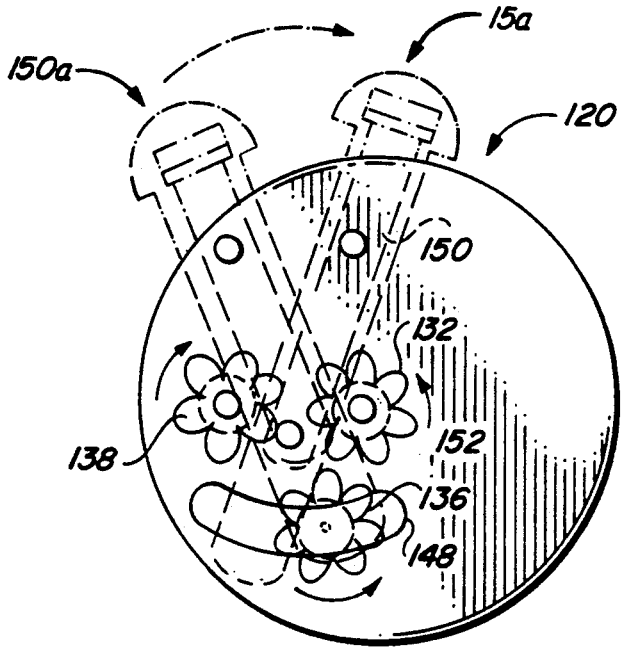
FIG. 11 is a rear section view of the speedometer cut along lines 11—11 of FIG. 10.

Referring to FIGS. 7 and 10 there is shown a speedometer assembly 121 have a bracket 122 which is connected with attachment assembly 124 to driver frame assembly 14 with attachment assembly 124. Referring to FIGS. 10 and 11, speedometer assembly 121 includes a display unit 130 which tracks distance and/or number of revolutions of driven wheel 44, and indicates the rate at which driven wheel 44 is turning. Construction of this speedometer assembly 121 is a standard off-the-shelf part and is well-known in the art.

Speedometer assembly 121 is connected to drive gear 132 located within housing 134. Drive gear 132 turns a gear (not shown) in speedometer assembly 121 to track speed and distance. Drive gear 132 is actuated either by drive gear 136 or drive gear 138. Referring to FIGS. 6 and 7 drive gear 136 is connected through socket 140 to cable 142. Cable 142 is turned by actuator assembly 144 in response to rotation of driven wheel 50. Construction of actuator assembly 144 and its connection to driven wheel 50 is well-known.

Referring to FIGS. 10 and 11, drive gear 136 pivots in slot 148 in housing 134. The position of drive gear 136 in slot 148 is adjusted by arm 150 which is pivotally connected to housing 134 with ratchets 152. Drive gear 138 continuously engages drive gear 132. Arm 150 has a first position 150*a* where drive gear 136 directly engages drive gear 138 to pivot drive gear 138 the opposite direction of drive gear 136, thereby rotating drive gear 132 the same direction as drive gear 136. When arm 150 moves to a second position 150*b*, drive gear 136 directly engages drive gear 132 thereby rotating drive gear 132 in the opposite direction as the rotation of drive gear 136. Accordingly, by pivoting arm 150 about ratchets 152, depending on the rotation direction of driven wheel 50 and pedals 38 and 40 about axis 32, the speedometer assembly 121 provides an indication of the rate and the amount of rotation of driven wheel 44 irrespective of driven wheel's 44 rotational direction.

Figure 14:
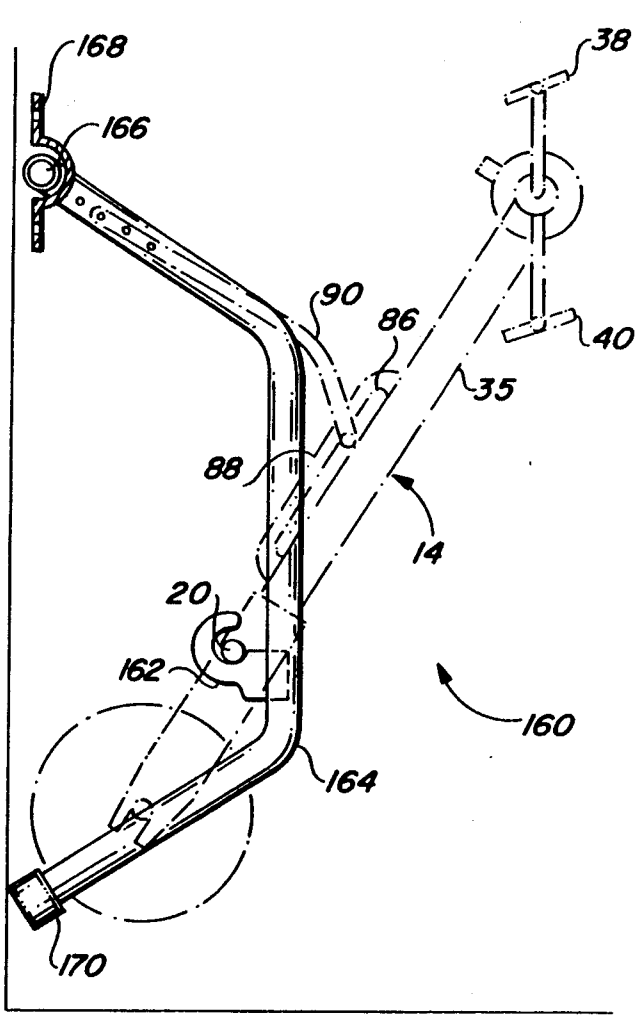
FIG. 14 is a side view of the exercise device shown in FIG. 12 in position for exercising the arms and upper body.
Figure 13:
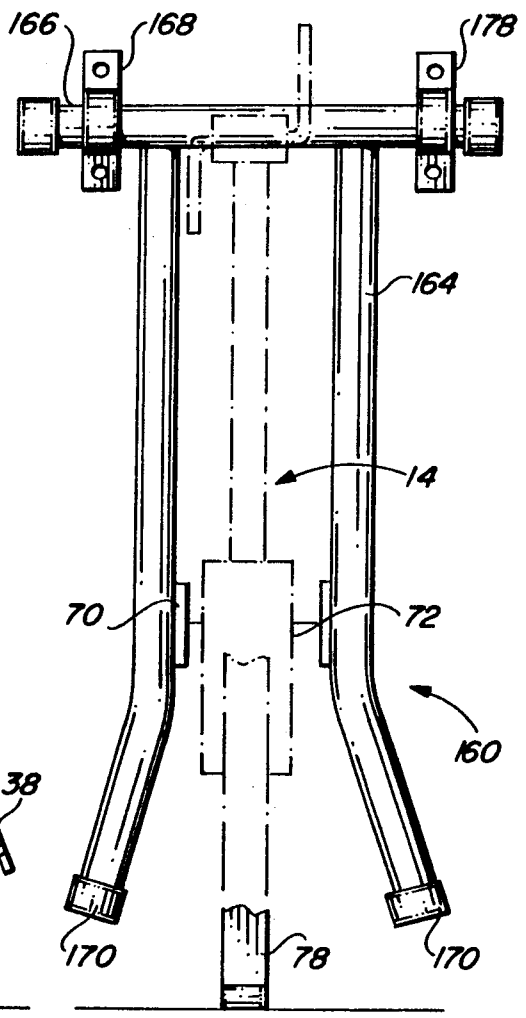
FIG. 13 is a front view of the exercise device shown in FIG. 12.
Figure 12:
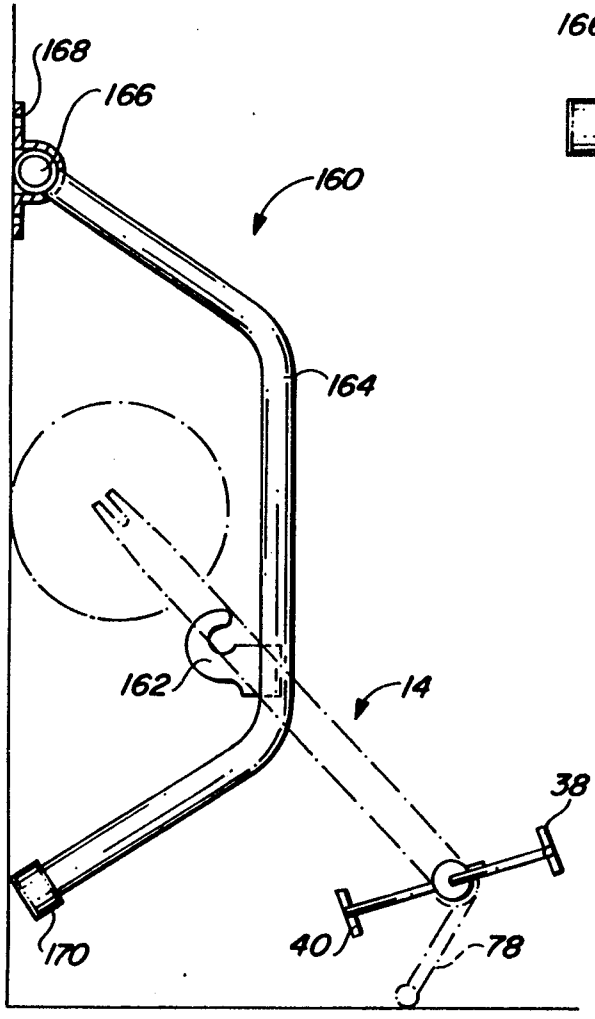
FIG. 12 is a side view, wall-mounted version of the exercise device.

Referring to FIGS. 12 through 14, there is shown an exercise assembly 160 which is adaptable to be mounted on a wall's surface or may be removed from the wall to rest on the floor. The exercise assembly 160 includes driver frame assembly 14 pivotally attached about screws 70 and 72 to a bracket 162 on U-shaped support frame 164. U-shaped support frame 164 is coupled to wall's surface with rod 166 and clamps 168 and 170 so that U-shaped support frame 164 pivots about rod 166 when reorienting the position of driver assembly frame 14. At the other end of U-shaped support frame 164 from clamp 168 are pads 172 that securely fit around the frame of U-shaped support frame 164.

Referring to FIGS. 12 and 13, there is shown the driver frame assembly 14 mounted to U-shaped support frame 164. Driver frame assembly 14 is operated in a downwardly inclined position so that pedals 38 and 40 on driver frame assembly 14 can be turned by foot. Further, a locating peg 78 contacts floor surface to provide stability to driver frame assembly 14.

Referring to FIG. 14, driver frame assembly 14 is shown arrested in an upwardly inclined position so that pedals 38 and 40 may be rotated by hand. Longitudinally extending frame 35 is attached to U-shaped support frame 164 with support arm 90 by bolting one end of support arm 90 to support frame 64 and the other end to slot 86 within flange 88. Although not shown, driver frame assembly 14 may pivot about screws 70 and 72 to a vertical storage position where longitudinally extending frame 35 is parallel to wall's surface. It is recognized that exercise assembly 160 permits exercise of the lower body and the upper body while being easily stored out-of-the-way when exercise assembly 160 is not being used.

This concludes the description of the preferred embodiments. A reading by those skilled in the art will bring to mind various changes without departing from the spirit and scope of the invention. It is intended, however, that the invention only be limited by the following appended claims.

What is claimed is:

1. An exercise device comprising:

a driving sprocket having a first axis of rotation;

means for rotating said sprocket about the first axis;

means having a second axis of rotation for supporting said sprocket about said first axis in a first position where said sprocket is adapted to be rotated by foot, and for rotating said sprocket about said second axis to a second position where said sprocket is adapted to be rotated by hand; and a seat having an elevation level and operative to support an exercise device operator, wherein the elevation level of said first axis when said sprocket in said first position is lower than the elevation level of said seat, and said elevation level of said first axis when said sprocket is in said second position is higher than the elevation level of said seat, the seat and the sprocket being dimensioned so that the operator can reach the sprocket with the operator's feet in the first position and the operator's hands in the second position, both while on the seat.

2. The exercise device as recited in claim 2 further comprising means for resisting the rotation of said sprocket about said first axis.

3. The exercise device as recited in claim 1 further comprising:

means for restricting the direction of rotation of said sprocket to a first direction; and means for changing the direction of rotation of said sprocket is restricted from the first direction to a second direction opposite from said direction.

4. An exercise device comprising:

a longitudinally extending frame;

a driving sprocket disposed adjacent one end of said frame having a first lateral axis exiting through the frame, said lateral axis being the axis of rotation of said sprocket;

a driven wheel disposed adjacent the other end of said frame from said sprocket and having a second lateral axis extending through the frame, said driven wheel rotating about said axis;

a pedal coupled to said sprocket operative to rotate said sprocket;

a chain connected between said driving sprocket and said driven wheel for rotating said wheel when said sprocket is rotated;

a support frame adapted to resting on a wall or floor surface, said support frame having pivot means connected to said longitudinal frame between said driving sprocket and said driven wheel for permitting said sprocket to rotate about said second longitudinal axis at least 180°;

a seat coupled to said support frame adapted to support an operator in a sitting position; and means for permitting the horizontal level of said pedals to be adjusted where said operator can contact said pedals with the foot while sitting on said seat when said pedals are in a first position and where said operator can contact said pedals with the hand while sitting on the seat when said pedals are in a second position, said pedal first position having a horizontal level lower than the seat level and said pedal second position having a horizontal level higher than the seat level.

5. The exercise device as recited in claim 4 further comprising a support arm connected between said support frame and said longitudinal frame for holding said longitudinal frame in a fixed position relative to said support frame when said sprocket is rotated.

6. The exercise device as recited in claim 5 wherein said support are further comprising means for adjusting the position of said longitudinally extending frame to said support frame.

7. The exercise device as recited in claim 4 further comprising means for resisting the rotation of said driven wheel about said first axis.

8. The exercise device as recited in claim 4 wherein said support frame has a generally U-shaped configuration.

9. The exercise assembly recited in claim 4 further comprising a reversible ratchet on the exercise unit for controlling resistance in either direction of rotation of the drive sprocket.

* * * * *